US006276108B1

(12) United States Patent
Padrun

(10) Patent No.: US 6,276,108 B1
(45) Date of Patent: Aug. 21, 2001

(54) DEVICE FOR SUPPORTING AND CONNECTING REINFORCING ELEMENTS FOR CONCRETE STRUCTURES

(75) Inventor: John Padrun, Cupertino, CA (US)

(73) Assignee: GOPA Enterprises, Cupertino, CA (US)

( * ) Notice: Subject to any disclaimer, the term of this patent is extended or adjusted under 35 U.S.C. 154(b) by 0 days.

(21) Appl. No.: 09/421,754

(22) Filed: Oct. 19, 1999

(51) Int. Cl.[7] ..... E04C 5/16

(52) U.S. Cl. ..... 52/684; 52/677; 52/686; 52/687

(58) Field of Search ..... 52/684, 677, 686, 52/687

(56) References Cited

U.S. PATENT DOCUMENTS

| | | | | |
|---|---|---|---|---|
| 1,278,437 | * | 9/1918 | Collings | 52/686 |
| 3,788,055 | * | 1/1974 | Holmes | 52/686 X |
| 4,110,951 | * | 9/1978 | Padrun | 52/686 |
| 4,617,775 | | 10/1986 | Padrun | 52/684 |
| 5,107,654 | * | 4/1992 | Leonardis | 52/677 X |
| 5,291,715 | * | 3/1994 | Basile | 52/687 |
| 5,371,991 | * | 12/1994 | Bechtel et al. | 52/686 |
| 5,791,816 | * | 8/1998 | McCallion | 52/677 X |
| 5,822,946 | * | 10/1998 | Rasmussen | 52/677 X |
| 6,161,360 | * | 12/2000 | Smith | 52/686 X |

FOREIGN PATENT DOCUMENTS

| | | | | |
|---|---|---|---|---|
| 367966 | * | 4/1963 | (CH) | 52/686 |
| 2633322 | * | 12/1989 | (FR) | 52/677 |
| 2006314 | * | 5/1979 | (GB) | 52/684 |
| 2139664 | * | 11/1984 | (GB) | 52/686 |
| 0170168 | * | 5/1982 | (NL) | 52/686 |

* cited by examiner

*Primary Examiner*—Milton Nelson, Jr.
*Assistant Examiner*—Rodney B. White
(74) *Attorney, Agent, or Firm*—Flehr Hohbach Test Albritton & Herbert LLP

(57) ABSTRACT

Device for supporting and connecting concrete reinforcing elements which has a base adapted to rest on a supporting surface, an upright post extending from the base, and a clip mounted on the post having a pair of orthogonal sockets engagable with two horizontally extending reinforcing elements for connecting the elements together at right angles to each other and holding the elements a predetermined distance above the supporting surface.

7 Claims, 3 Drawing Sheets

DEVICE FOR SUPPORTING AND CONNECTING REINFORCING ELEMENTS FOR CONCRETE STRUCTURES

This invention pertains generally to concrete structures and, more particularly, to a support stand with a clip for connecting reinforcing elements together and holding them in position while concrete is poured.

U.S. Pat. Nos. 4,110,951 and 4,617,775 disclose clips for use in connecting reinforcing bars together in the construction of concrete slabs and the like. The clip shown in U.S. Pat. No. 4,110,951 is designed for use with intersecting or crossing bars, and the clip shown in U.S. Pat. No. 4,617,775 is designed for use with parallel bars. These clips provide an attractive alternative to the wires which are widely used for tying reinforcing bars together.

Another consideration with reinforcing bars in slabs is holding them above the deck when the concrete is poured so that they will be positioned at the center of the slab. That is most commonly done by propping the bars up with blocks or with supports which are sometimes referred to as "chairs".

It is in general an object of the invention to provide a new and improved device for use in supporting and connecting reinforcing elements in concrete structures.

Another object of the invention is to provide a device of the above character which overcomes the limitations and disadvantages of the ties and supports heretofore employed in connecting reinforcing bars together and positioning them in concrete slabs.

These and other objects are achieved in accordance with the invention by providing a device for supporting and connecting concrete reinforcing elements which has a base adapted to rest on a supporting surface, an upright post extending from the base, and a clip mounted on the post having a pair of orthogonal sockets engagable with two horizontally extending reinforcing elements for connecting the elements together at right angles to each other and holding the elements a predetermined distance above the supporting surface.

Figure 1:
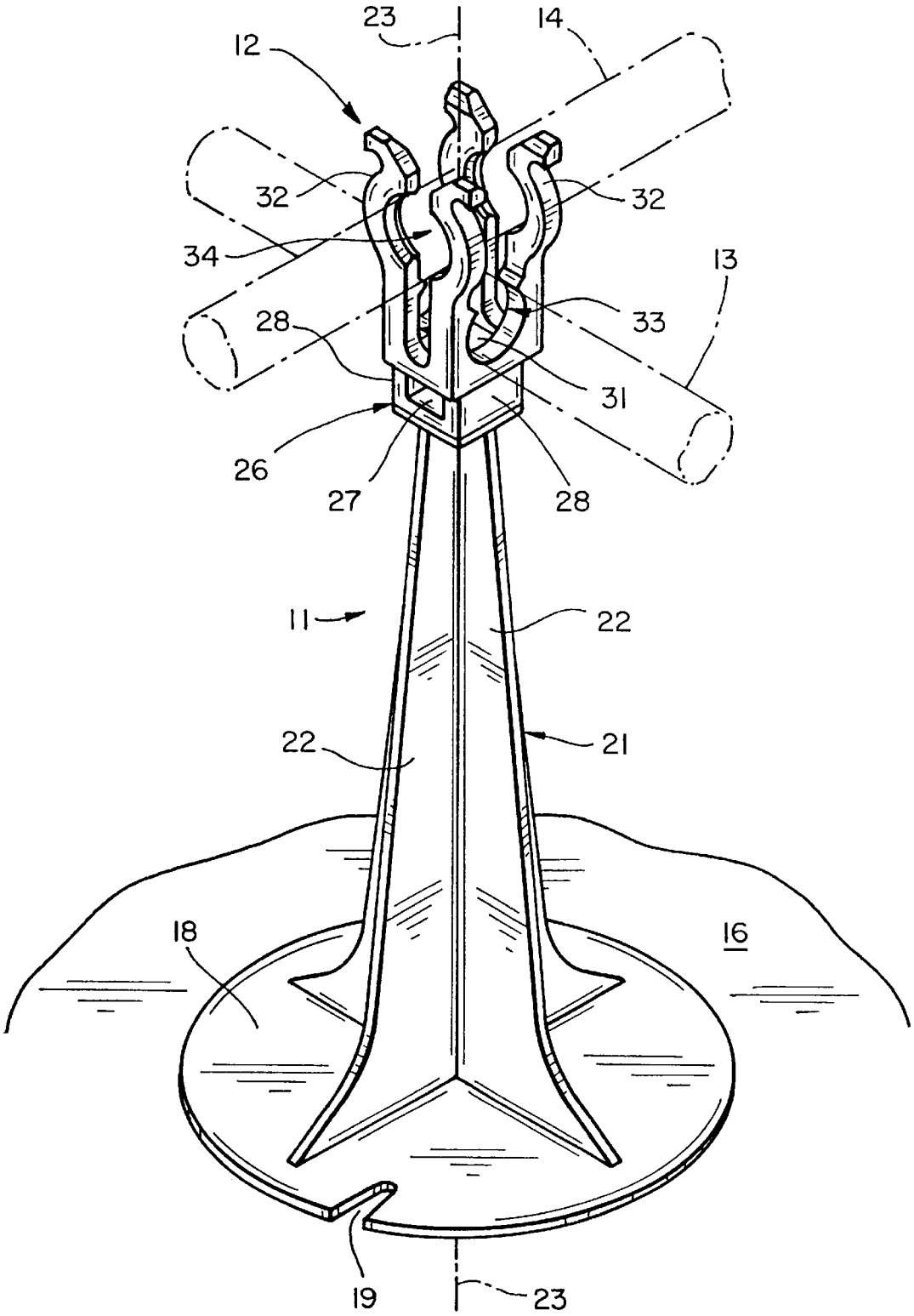
FIG. 1 is an isometric view of one embodiment of a device for supporting and connecting reinforcing elements for concrete structures in accordance with the invention.
Figure 2:
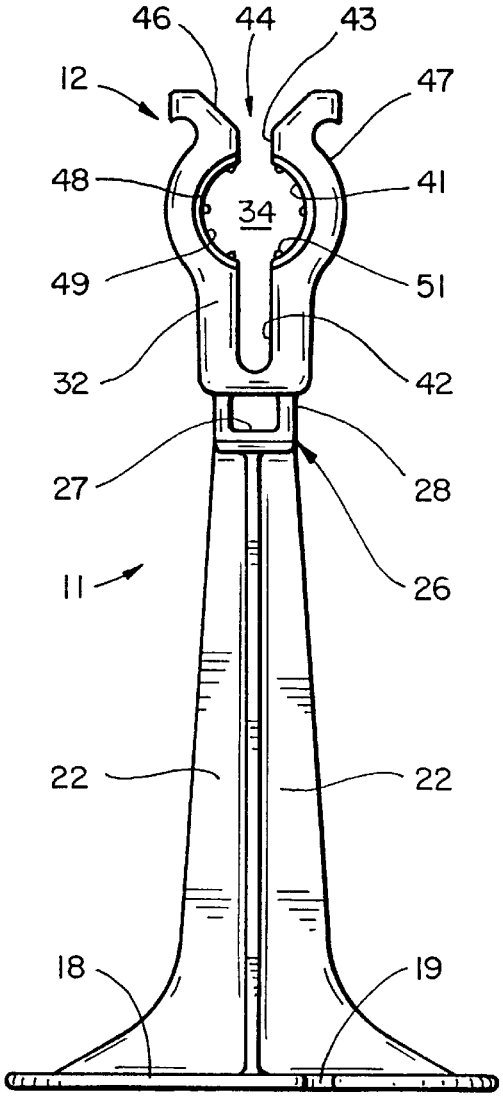
FIG. 2 is a fragmentary front elevational view of the embodiment of FIG. 1.
Figure 3:
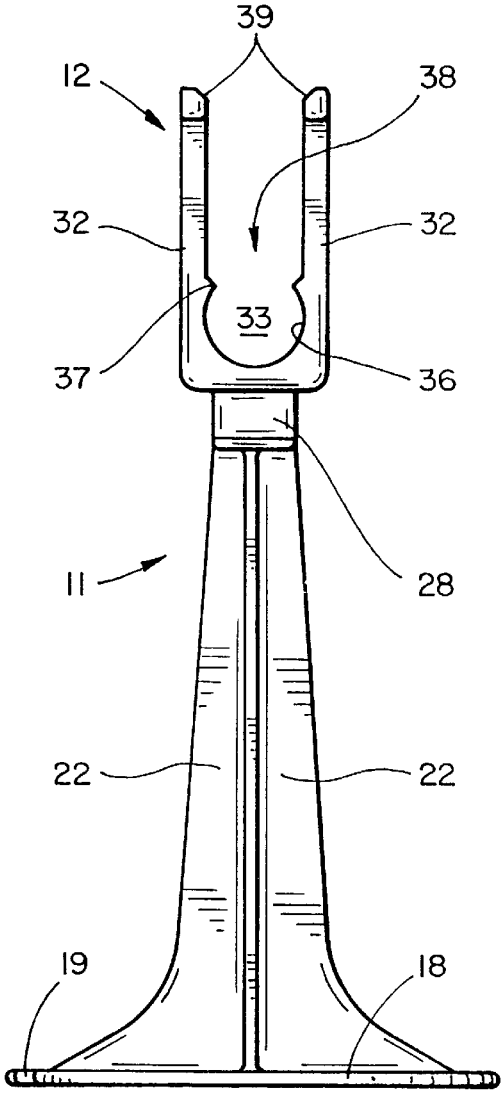
FIG. 3 is a fragmentary side elevational view of the embodiment of FIG. 1.

Illustrated in the drawings, the device includes a stand 11 with a clip 12 for holding two horizontally extending reinforcing elements 13, 14 together at right angles to each other and positioning those elements a predetermined distance above a supporting surface 16 on which a concrete slab is to be poured, e.g. at the center of the slab.

The stand has a generally circular base 18 which is adapted to rest upon the supporting surface. The base has a pair of slots 19 for receiving nails or other fasteners by which the device can be affixed to the support, if desired.

A post 21 consisting of a plurality of tapered vanes 22 extends upwardly from the base. The vanes decrease in lateral dimension as they rise, and they intersect along the vertical centerline 23 of the device. In the embodiment illustrated, there are four vanes which are spaced in quadrature of each other.

The clip is mounted to the upper ends of the vanes by means of a saddle 26 which has a generally square, horizontally extending base 27 with a pair of upstanding legs 28 on opposite sides thereof. The base of the saddle is connected to the upper ends of the vanes and is coextensive in lateral dimension with them.

The clip has a generally square, horizontally extending base 31 and a pair of upstanding flanges 32. This base is connected to the upper ends of legs 28 and is thus spaced above the base of the saddle. The flanges form sockets 33, 34 for holding the reinforcing elements in the desired position.

Socket 33 is formed between the flanges, just above the base of the clip. It has a cylindrical side wall 36 which is formed in the inner faces of the flanges and the upper surface of the base. This wall extends through an angle of approximately 270 and terminates in beveled lugs 37 which project inwardly from the inner faces of the flanges. The upper portion of the socket, i.e. the space 38 between the lugs, is open, and the reinforcing element is snapped into the socket through this opening. The inner corners 39 at the upper ends of the flanges are beveled to facilitate insertion of the reinforcing element into the socket.

Socket 34 is formed in the flanges above socket 33 and at right angles to it. This socket comprises aligned circular openings 41 which are formed in the upper portions of the two flanges. Slots 42 extend between these openings and the base of the clip to provide flexibility for snapping the reinforcing element into the socket, and passageways 43 extend between the openings and the upper ends of the flanges to form an opening 44 through which the element is introduced into the socket. The corners 46 at the upper end of the passageways are beveled to facilitate insertion of the elements. The outer edges 47 of the flanges are contoured to follow the contours of the openings, slots and passageways so as to minimize the amount of material used in the device.

The walls 48 which form openings 41 are conically tapered, with thin, flexible lips 49 at the edges of the openings. This structure is similar to that show in U.S. Patent 4,110,951, and it serves to facilitate insertion and gripping of the reinforcing element. A plurality of circumferentially spaced teeth 51 extend radially from the lips to further grip the reinforcing elements.

The entire device is preferably formed by injection molding as a unitary structure of a resilient plastic material. The tapered fins and the contoured clip reduce the amount of material required and, hence, the cost of the device.

As noted above, it is generally desirable to place reinforcing elements at the vertical center of a horizontally extending concrete slab, and stands of different heights can be provided for use in slabs of different thicknesses. To accommodate reinforcing elements of different diameters (e.g. ⅜, ½ or ⅝ inch re-bar or 9/16 inch tendons), clips having different sized sockets can be provided. By varying the length of the legs of the saddle, the same stand can be used with clips of different sizes without affecting the placement of the elements in the slab. This reduces tooling costs in that the same mold can be used for the stand regardless of the size of the clip.

Figure 4:
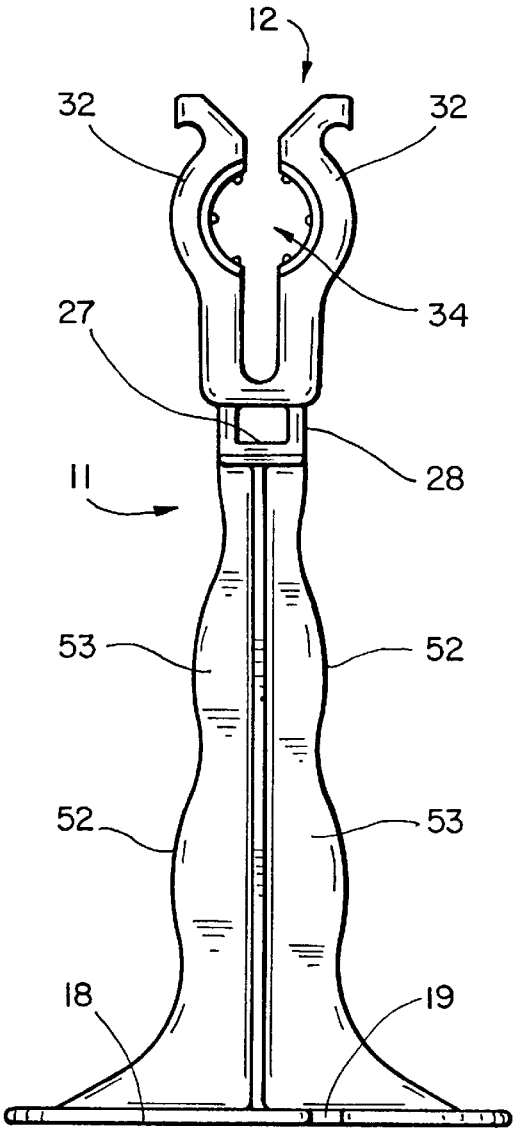
FIG. 4 is front elevational view of another embodiment of a device for supporting and connecting reinforcing elements for concrete structures in accordance with the invention.
Figure 5:
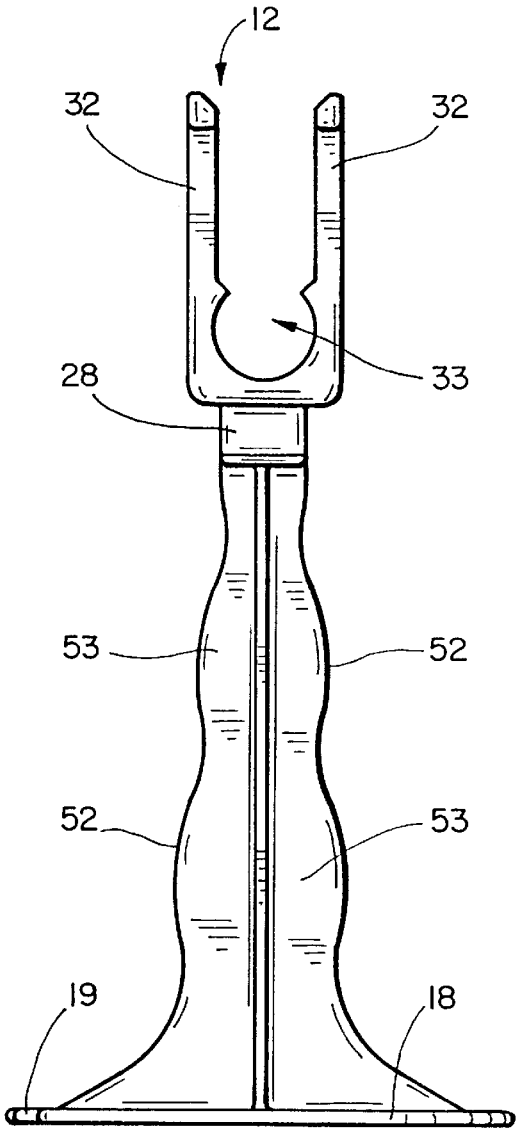
FIG. 5 is a side elevational view of the embodiment of FIG. 4.

The embodiment of FIG. 4 is similar to the embodiment of FIG. 1 except that the edges 52 of vanes 53 which form the post are scalloped in order to further reduce the amount of material use in the device.

Operation and use of both embodiments is the same. After the reinforcing elements have been laid out in a criss-cross pattern on the surface where the slab is to be poured, the elements are lifted at their intersections, the devices are positioned under the elements, and the elements are pressed down into the sockets. The bases of the stands rest on the supporting surface, and can be anchored to that structure by nails or other suitable means, if desired. The clips hold the reinforcing elements together, eliminating the need for tie wires or other connectors, and the stands position the elements at the desired height in the slab. The devices can be used with different types of reinforcing elements, including conventional re-bar as well as tendons for use in post-tensioning applications.

It is apparent from the foregoing that a new and improved device for supporting and connecting reinforcing elements for concrete structures has been provided. While only certain presently preferred embodiments have been described in detail, as will be apparent to those familiar with the art, certain changes and modifications can be made without departing from the scope of the invention as defined by the following claims.

What is claimed is:

1. In a device for supporting and connecting concrete reinforcing elements: a base adapted to rest on a supporting surface, a plurality of tapered vanes extending upwardly from the base and intersecting along a centerline of the device, a saddle having a pair of upstanding legs at the upper ends of the vanes, and a clip mounted on the legs having a pair of orthogonal sockets engagable with two horizontally extending reinforcing elements for connecting the elements together at right angles to each other and holding the elements a predetermined distance above the supporting surface.

2. The device of claim 1 wherein the entire device is molded as a unitary structure of a resilient plastic material.

3. In a device for supporting and connecting concrete reinforcing elements: a post consisting of a plurality of longitudinally tapered vanes which are joined together along a common central axis and extend from the axis in radial directions, and a clip at one end of the post for connecting two reinforcing elements together and holding the elements in a predetermined position while concrete is poured around them.

4. The device of claim 3 further including a base at the end of the post opposite the clip adapted to rest on a supporting surface.

5. The device of claim 3 wherein the vanes and the clip are molded as a unitary structure of a resilient plastic material.

6. The device of claim 3 wherein the clip is connected to the post by a saddle having a base affixed to the one end of the post and a pair of legs interconnecting the base and the clip.

7. The device of claim 3 wherein the outer edges of the vanes are scalloped.

* * * * *